US008381366B2

(12) United States Patent
Hede et al.

(10) Patent No.: US 8,381,366 B2
(45) Date of Patent: Feb. 26, 2013

(54) ATTACHMENT BUCKLE FOR ADJUSTING AND TIGHTENING A STRAP

(75) Inventors: Jean-Marc Hede, Domene (FR); Paul Petzl, Barraux (FR)

(73) Assignee: Zedel, Crolles (FR)

( * ) Notice: Subject to any disclaimer, the term of this patent is extended or adjusted under 35 U.S.C. 154(b) by 311 days.

(21) Appl. No.: 12/591,117

(22) Filed: Nov. 9, 2009

(65) Prior Publication Data

US 2010/0125980 A1 May 27, 2010

(30) Foreign Application Priority Data

Nov. 24, 2008 (FR) ..... 08 06591

(51) Int. Cl.
*A44B 11/06* (2006.01)

(52) U.S. Cl. ..... 24/170; 24/168; 24/194; 24/196; 24/171

(58) Field of Classification Search ..... 24/163 R, 24/170, 191, 194, 196, 197
See application file for complete search history.

(56) References Cited

U.S. PATENT DOCUMENTS

| | | | | | |
|---|---|---|---|---|---|
| 1,021,088 | A | * | 3/1912 | Brown, R. | 24/170 |
| 1,361,647 | A | * | 12/1920 | Vaisset | 24/170 |
| 1,602,895 | A | * | 10/1926 | Freysinger | 24/191 |
| 1,997,653 | A | * | 4/1935 | Lues Reiter | 24/193 |
| 2,938,254 | A | | 5/1960 | Gaylord | |
| 3,760,464 | A | * | 9/1973 | Higuchi | 24/323 |
| 4,069,554 | A | * | 1/1978 | Minolla et al. | 24/196 |
| 4,414,713 | A | * | 11/1983 | Prete, Jr. | 24/193 |
| 4,444,432 | A | * | 4/1984 | Kikuchi | 297/476 |
| 5,205,021 | A | * | 4/1993 | Durand | 24/163 R |
| 5,291,638 | A | * | 3/1994 | Huang | 24/170 |
| 5,432,984 | A | | 7/1995 | Petzl | |
| 5,471,714 | A | | 12/1995 | Olson | |
| 5,487,187 | A | * | 1/1996 | Zide et al. | 2/462 |
| 5,909,851 | A | * | 6/1999 | Fujimoto | 24/196 |
| 6,539,592 | B1 | * | 4/2003 | Choi et al. | 24/197 |
| 6,820,310 | B2 | * | 11/2004 | Woodard et al. | 24/171 |
| 2007/0187445 | A1 | * | 8/2007 | Krapka | 224/197 |
| 2007/0226961 | A1 | * | 10/2007 | Anderson et al. | 24/170 |

FOREIGN PATENT DOCUMENTS

| | | | |
|---|---|---|---|
| DE | 20 2007 010 746 | U1 | 11/2007 |
| EP | 0 582 559 | A2 | 2/1994 |
| EP | 0 614 626 | A1 | 9/1994 |
| FR | 1 305 668 | | 8/1962 |

* cited by examiner

*Primary Examiner* — Robert J Sandy
*Assistant Examiner* — David Upchurch
(74) *Attorney, Agent, or Firm* — Oliff & Berridge, PLC

(57) ABSTRACT

An attachment buckle for fitting and adjusting a strap, composed of a pair of superposed rings of different dimensions and a transverse slot for the strap to pass through. The second ring is articulated on the first ring by means of a connecting spring designed to press the second ring against the first ring and to urge said second ring slidingly to the blocking position.

4 Claims, 8 Drawing Sheets

ATTACHMENT BUCKLE FOR ADJUSTING AND TIGHTENING A STRAP

BACKGROUND OF THE INVENTION

The invention relates to an attachment buckle for fitting and adjusting a strap, composed of a pair of superposed rings presenting rectangular frames of different dimensions, the larger first ring comprising a rectangular first opening arranged under a rectangular second opening arranged in the second ring of smaller size so as to define a transverse slot for the strap to pass through, the slot being arranged between one of the outside edges of the second ring and the adjacent side of the first opening of the first ring, the buckle being either in a position blocking the strap in the slot following application of a clamping force, or in an releasing position after a swivelling movement of the second ring resulting in the passage zone in the slot being enlarged.

STATE OF THE ART

According to the buckle described in the document EP 614626, the second ring is fitted floating on the first ring and is secured to the latter by a sewn strap buckle surrounding the two rear crosspieces of the rings. The other strap end is securedly blocked in the slot between the two rings as soon as a traction force is applied. When the strap is no longer taut, the blocking effect disappears and the strap can then slide in the slot, in particular if a push is exerted on the end of the strap. To prevent this involuntary loss of adjustment of the attachment buckle, the strap then has to be retigthened by pulling on the free end of the strap.

According to another known attachment buckle, the top second ring is guided in translation along the opposite edges of the bottom ring and is pushed by flexible means to the blocking position. Sliding of the second ring makes total opening of the buckle impossible, which limits the cross-section for passage of a strap equipped with an end stop.

OBJECT OF THE INVENTION

The object of the invention consists in providing an attachment buckle having optimum blocking of the strap preventing any undesirable loss of adjustment and enabling a large opening to be obtained for fitting the strap.

The device according to the invention is characterized in that the top second ring is articulated on the bottom first ring by means of a connecting spring designed to press the second ring against the first ring and to urge said second ring slidingly to the blocking position.

The pinching effect is determined to prevent loosening when the strap is no longer taut, while at the same time allowing a possibility of sliding when pulling on the end of the strap to perform adjustment. Insertion of the strap in the buckle is made easier due to the large clearance of the second ring with respect to the first ring.

According to a preferred embodiment, the connecting spring is formed by a helical spring passing through a median hole of the second ring, said spring being secured via its two opposite ends to the first ring. The helical spring extends in the transverse direction of the axis of swivelling of the second ring.

The hole for passage of the connecting spring is preferably arranged in a protuberance outside the opening of the second ring, said protuberance extending in the direction of sliding of the second ring to the blocking position.

BRIEF DESCRIPTION OF THE DRAWINGS

Other advantages and features will become more clearly apparent from the following description of a particular embodiment of the invention given for non-restrictive example purposes only and represented in the appended drawings, in which.

DESCRIPTION OF A PREFERRED EMBODIMENT OF THE INVENTION

Figure 1:
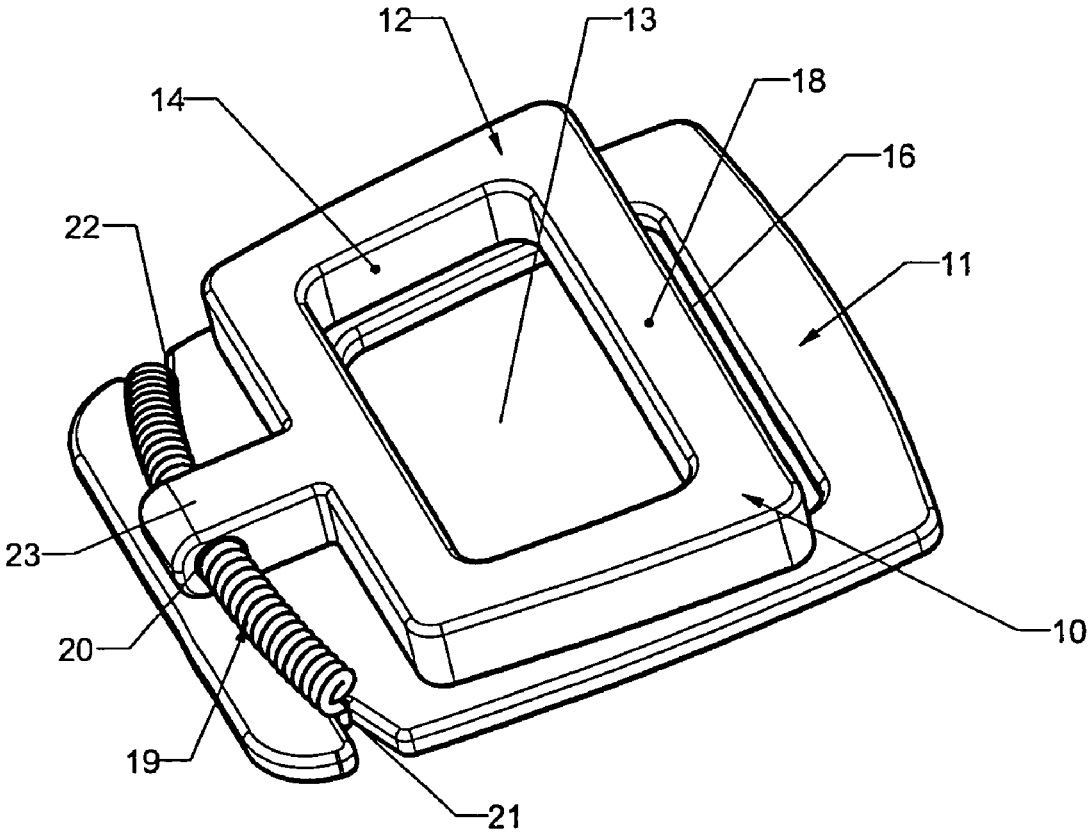
FIG. 1 represents a schematic perspective view of the buckle according to the invention.
Figure 2:
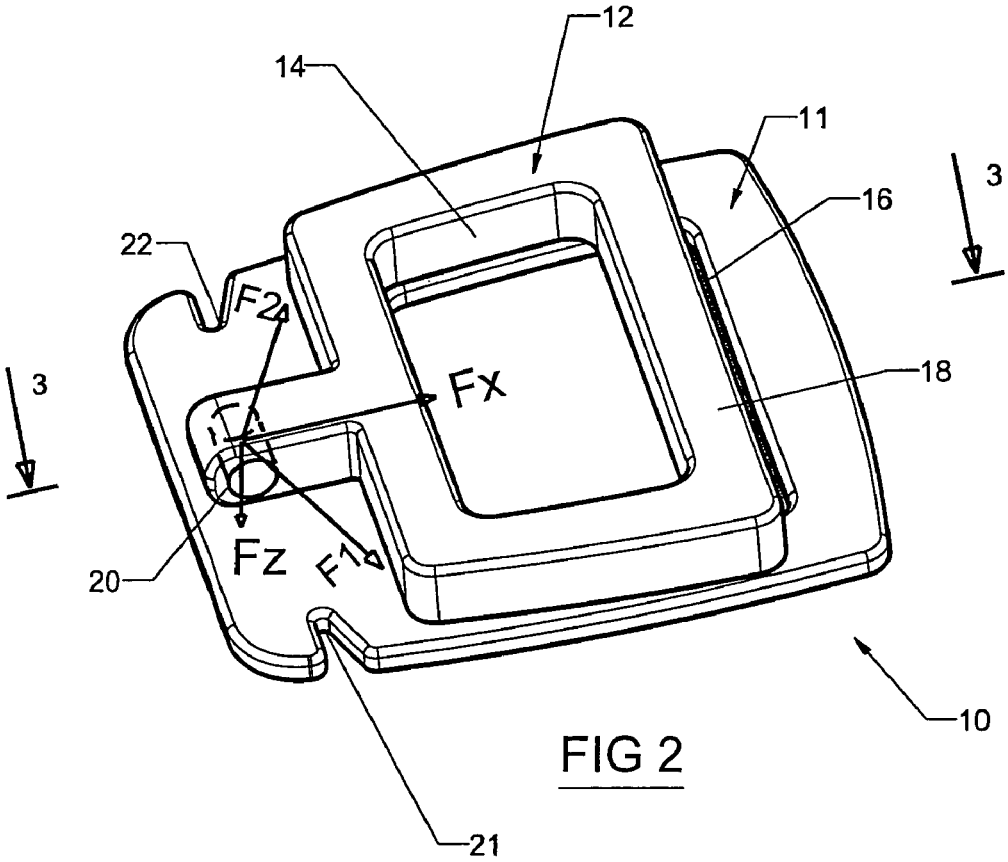
FIG. 2 shows the buckle of FIG. 1 with the distribution of the elastic forces exerted on the second ring in the blocking position, the spring not being represented for the sake of clarity of the drawing.
Figure 3:
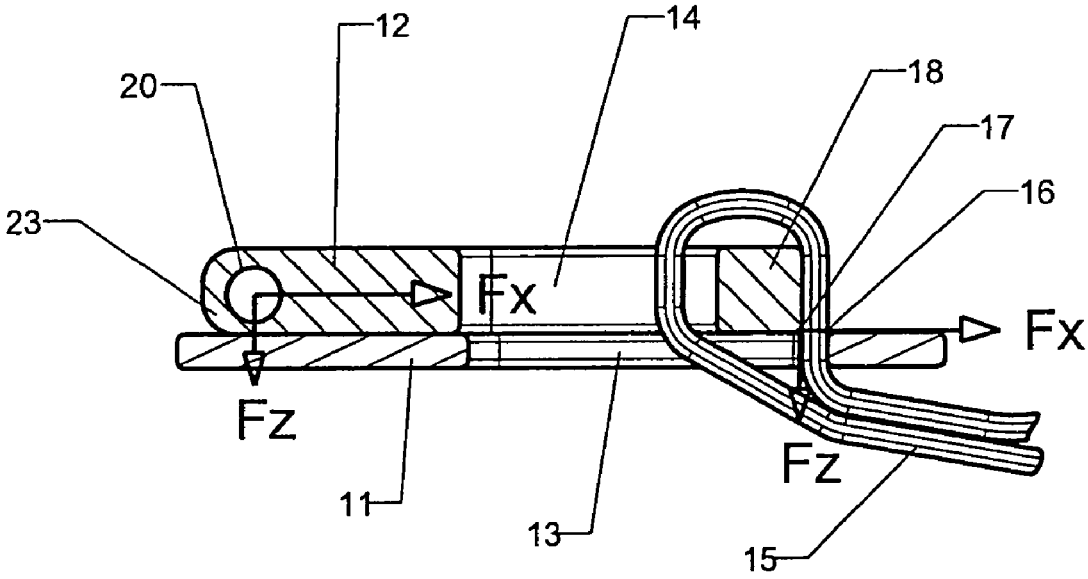
FIG. 3 is a cross-sectional view along the line 3-3 of FIG. 2.

In FIGS. 1 to 3, an adjustable attachment buckle 10 is composed of a pair of superposed rings 11, 12 having rectangular or trapezoid structures of different dimensions. The larger first ring 11 comprises a first opening 13 arranged under a rectangular second opening 14 arranged in the second ring 12 which is of smaller size.

The width of strap 15 is slightly smaller than that of openings 13, 14 to prevent any friction of strap 15 against the opposite lateral sides of rings 11, 12.

With reference to FIG. 3, strap 15 passes through the two openings 13, 14 and the end of strap 15 is then inserted in a transverse slot 16 located between the outside edge 17 of second ring 12, and the adjacent side of first opening 13. It then passes again in the opposite direction through first ring 11 forming a turn around the right-hand crosspiece 18 of second ring 12.

Top second ring 12 is articulated on bottom first ring 11 by means of a connecting spring 19 which is arranged to press second ring 12 against the top surface of first ring 11 and to urge second ring 12 with a sliding movement to the blocking position to block strap 15 in slot 16.

Connecting spring 19 is for example formed by a helical spring passing through a median hole 20 arranged in a protuberance 23 of second ring 12. The helical spring is secured via both ends in opposite notches 21, 22 of first ring 11 so as to constitute the articulation axis of second ring 12. Elastic deformation of the helical spring also enables a small sliding travel of second ring 12 when strap 15 is blocked.

FIG. 2 shows the breakdown of the forces applied on second ring 12 by connecting spring 19, which is not represented for the sake of clarity of the drawing. The two elementary traction forces F1 and F2 exerted by helical spring 19 on protuberance 23 of second ring 12 generate a first component $F_x$ for sliding movement to the blocking position and a second component $F_z$ designed to press second ring 12 against first ring 11.

Figure 4:
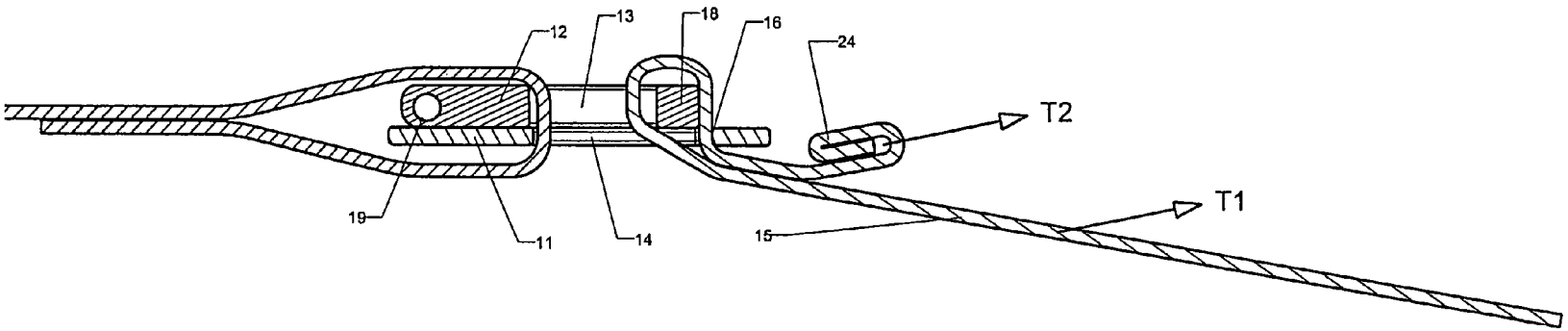
FIGS. 4-6 illustrate cross-sectional views of the buckle with a strap respectively in the closed blocking position, in the course of opening, and in the totally open position.

Operation of buckle 10 according to the invention is as follows:

In FIG. 4, a buckle 10 is closed and the right-hand strand of strap 15 is blocked in slot 16. A traction force T1 exerted on strap 15 makes second ring 12 slide to the blocking position.

This blocking state continues to exist even when the strap is no longer taut due to the first component $F_x$ of connecting spring 19 which disables any involuntary loosening of buckle 10. Blocking of strap 15 does however remain sufficiently moderate to allow the strap to slide in slot 16 when a pulling action is performed on end stop 24 of the strap at T2 for adjustment of the latter.

Figure 5:
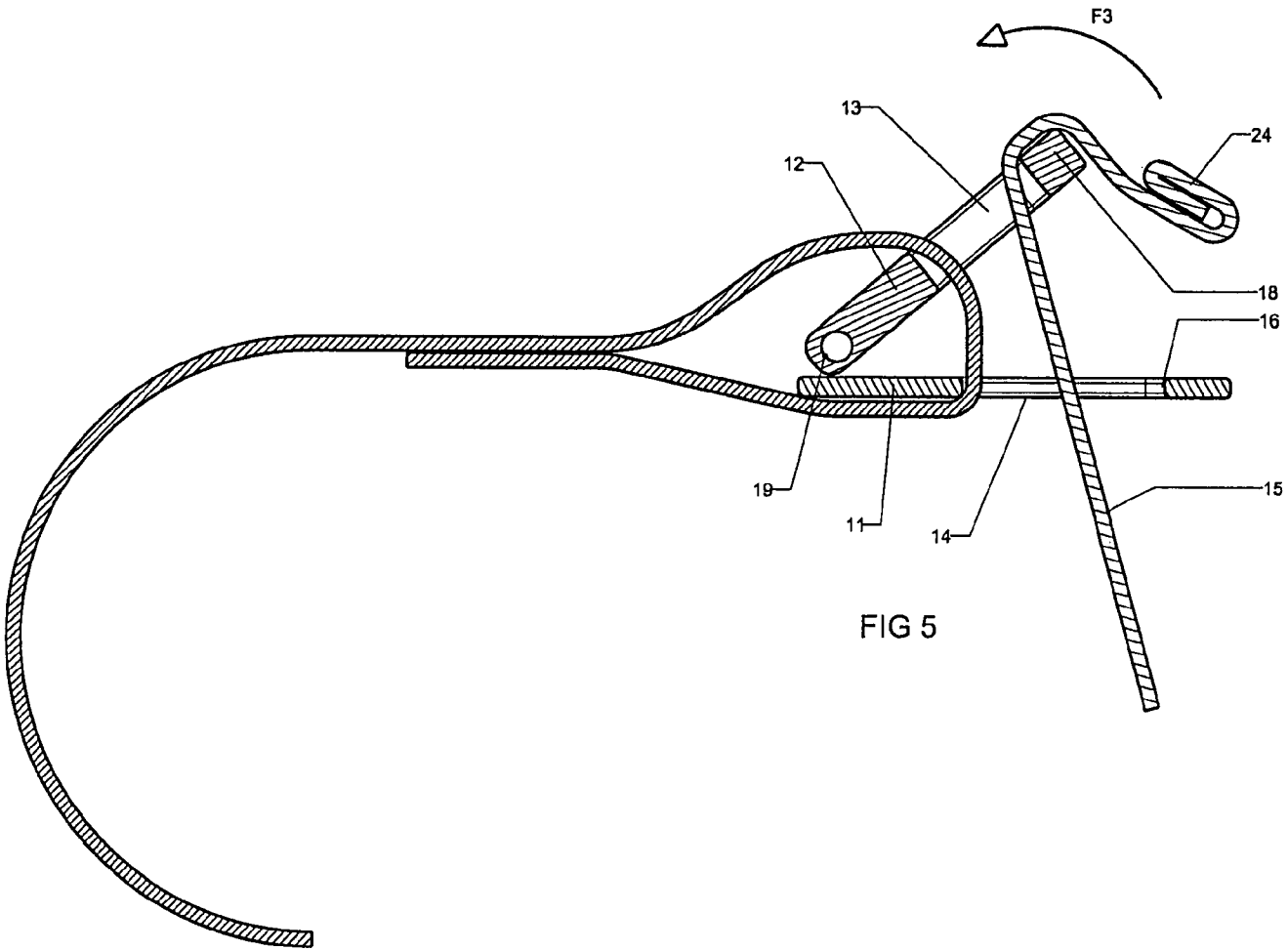

In FIG. 5, buckle 10 is in the course of opening after second ring 12 has been raised in the direction of arrow F3. A swivelling movement of second ring 12 takes place around the articulation axis of helical spring 19, and the end of second ring 12 remains pressing against first ring 11. Strap 15 is released and can be moved freely in buckle 10.

Figure 6:
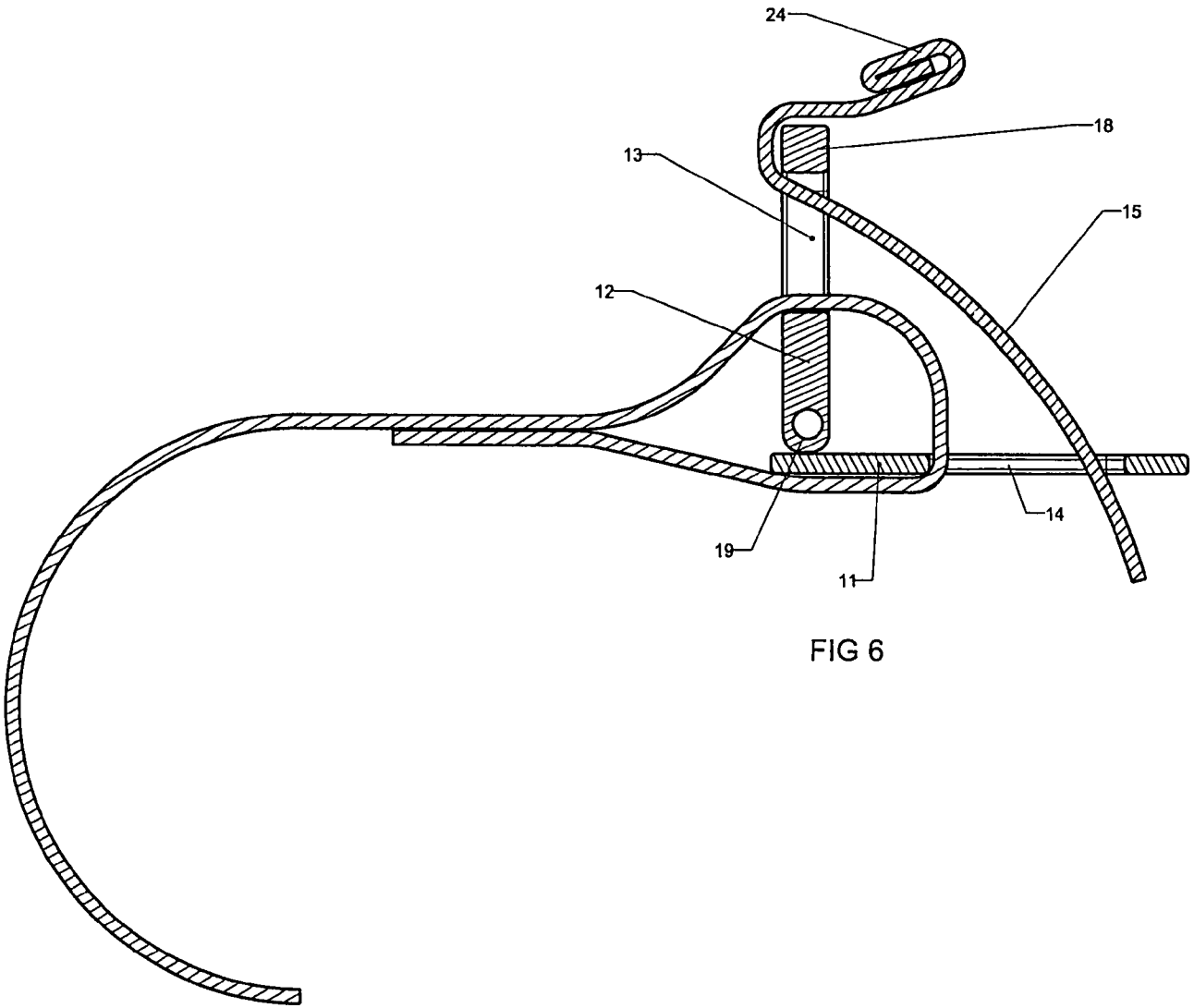

In FIG. 6, buckle 10 is fully open when second ring 12 extends perpendicularly to first ring 11. This results in a large passage to release or engage end stop 24 of strap 15, and the second component $F_z$ of spring 19 keeps the end of second ring 12 pressing against first ring 11.

Figure 7:
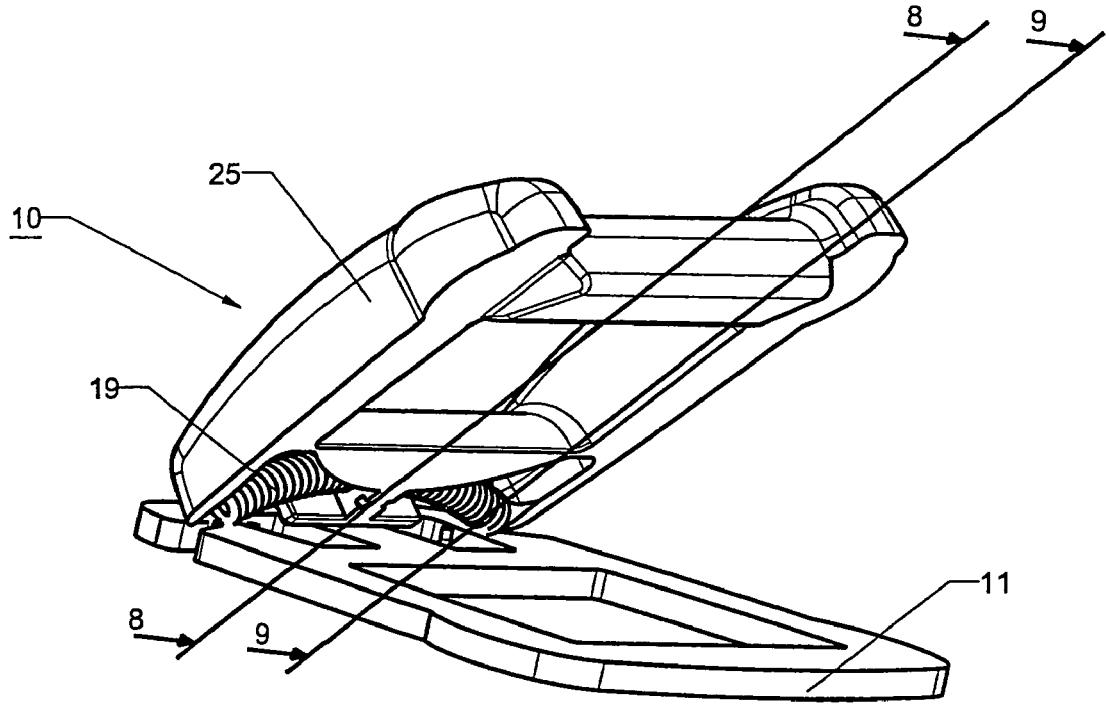
FIG. 7 shows a perspective view of an alternative embodiment of the buckle.
Figure 8:
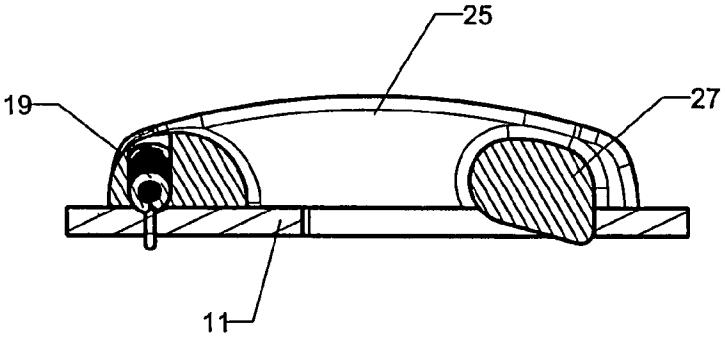
FIGS. 8 and 9 are cross-sectional views along the lines 8-8 and 9-9 of FIG. 7.
Figure 9:
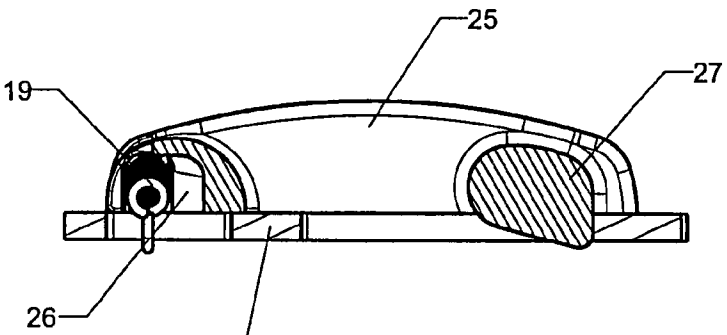

FIGS. 7-9 show an example of an embodiment of buckle 10 with second ring 12 totally moulded from casting in a plastic coating 25. The two branches of helical connecting spring 19 extend transversely with clearance in a cavity 26 provided at the rear part of coating 25 to allow the spring to deform when strap 15 is blocked. The coating around crosspiece 18 is in the form of a stud 27 designed to totally penetrate into first opening 13 of first ring 11 when the strap is blocked as in FIG. 4. Second ring 12 is then pressing completely on first ring 11.

It is clear that helical connecting spring 19 of buckle 10 can be replaced by any other equivalent type of spring.

The invention claimed is:

1. An attachment buckle for fitting and adjusting a strap, the attachment buckle comprising:

a pair of superposed rings in the form of rectangular frames of different dimensions;

a larger first ring of the pair of superposed rings defining a rectangular first opening; and a smaller second ring of the superposed rings defining a rectangular second opening, wherein the first opening is arranged under the rectangular second opening so as to define a transverse slot for the strap to pass through, the slot being arranged between an outside edge of the second ring and an adjacent side of the first opening of the first ring, the buckle being either in a blocking position that blocks the strap in the slot following application of a clamping force, or in a releasing position after a swivelling movement of the second ring resulting in a passage zone in the slot being enlarged, wherein the second ring is articulated on the first ring by means of a connecting spring designed to press the second ring against the first ring and to urge the second ring to slide to the blocking position, wherein the connecting spring is formed by a helical spring passing through a median hole of the second ring, the helical spring being secured via its two opposite ends to the first ring, wherein the helical spring extends in the transverse direction of the axis of swivelling of the second ring.

2. The attachment buckle according to claim 1, wherein the median hole for the connecting spring to pass through is arranged in a protuberance outside the opening of the second ring, the protuberance extending in a direction of sliding of the second ring to the blocking position.

3. The attachment buckle according to claim 1, wherein the second ring is moulded as a casting made from plastic material, and the connecting spring extends transversely with clearance in a cavity provided at a rear part of the casting to allow deformation of the spring when blocking of the strap takes place.

4. The attachment buckle according to claim 3, wherein the casting includes a stud opposite the cavity designed to penetrate into the first opening of the first ring when the strap is blocked.

* * * * *